United States Patent [19]

Hara et al.

[11] Patent Number: 4,781,908

[45] Date of Patent: Nov. 1, 1988

[54] PROCESS FOR THE INFUSIBILIZING TREATMENT OF PITCH FIBER

[75] Inventors: Yojiro Hara; Atsuki Kodama, both of Fukushima, Japan

[73] Assignees: Nitto Boseki Co., Ltd., Fukushima; Kawasaki Steel Corporation, Kobe, both of Japan

[21] Appl. No.: 923,866

[22] Filed: Oct. 28, 1986

[30] Foreign Application Priority Data

Nov. 7, 1985 [JP] Japan ..... 60-249833

[51] Int. Cl.[4] ..... D01F 9/12; D01F 9/14

[52] U.S. Cl. ..... 423/447.4; 423/447.1; 423/447.2; 423/447.6; 423/447.9; 264/29.2

[58] Field of Search ..... 423/447.1, 447.2, 447.4, 423/447.6, 447.9; 264/29.2

[56] References Cited

U.S. PATENT DOCUMENTS

| | | | |
|---|---|---|---|
| 3,552,922 | 1/1971 | Ishikawa et al. | 423/447.4 |
| 3,997,654 | 12/1976 | Kölling et al. | 423/447.4 |
| 4,259,307 | 3/1981 | Maruyama | 423/447.4 |
| 4,275,051 | 6/1981 | Barr | 264/29.2 |
| 4,276,278 | 6/1981 | Barr et al. | 423/447.4 |
| 4,496,631 | 1/1985 | Adachi et al. | 423/447.2 |

FOREIGN PATENT DOCUMENTS

| | | | |
|---|---|---|---|
| 0102705 | 3/1984 | European Pat. Off. | 423/447.2 |
| 0133457 | 2/1985 | European Pat. Off. | 423/447.1 |

*Primary Examiner*—John Doll
*Assistant Examiner*—Robert M. Kunemund
*Attorney, Agent, or Firm*—Wegner & Bretschneider

[57] ABSTRACT

The present invention relates to a process for the infusibilization of pitch fiber which comprises, in the production of pitch type carbon fiber, attaching a powder of solid lubricant to a pitch fiber and then subjecting the pitch fiber to an infusibilizing treatment. According to the present invention, the use of oxidant used in prior processes can be excluded, the process can be operated with a high safety, and the period of time required for the infusibilization can be shortened. Further, the infusibilized fiber obtained according to the invention can directly be introduced into the carbonization process, without any particular washing treatment and the like.

6 Claims, No Drawings

PROCESS FOR THE INFUSIBILIZING TREATMENT OF PITCH FIBER

BACKGROUND OF THE INVENTION

1. Field of the Invention

The present invention relates to a process for producing a carbon fiber by using pitch as starting material, and more particularly to a process for infusibilizing pitch fiber which comprises subjecting a pitch fiber to an oxidizing treatment to convert it to an infusible fiber.

2. Brief Description of the Prior Art

Recently, the process for producing a carbon fiber by using pitch as starting material has been watched with interest. The merit of this process consists in that a less expensive carbon fiber can be produced by it because pitch is less expensive than the starting materials of the prior processes such as PAN (polyacrylonitrile) and rayon, that a carbon fiber of high strength and high elasticity can be produced without carrying out the complicated stretching treatment in the firing process if a liquid crystal is used as the starting material of spinning, and that yield of carbonization is high. Thus, it is actively being studied and developed today.

The production of carbon fiber using pitch as starting material generally starts from the preparation of spinning pitch. Thus, crude coal tar pitch, petroleum pitch or the like, used as raw material of the process, is subjected to various treatments such as distillation, heat treatment, filtration, hydrogenation, fractionation using solvent, and the like either alone or in combination to remove the components obstructing the spinning process, such as low-boilding point volatile components, insoluble solid components and the like, from the pitch, to homogenize the quality of pitch and to make its quality appropriately heavy. Thus, an optically isotropic or optically anisotropic spinning pitch is obtained. The properties of a spinning pitch can be evaluated by measuring various parameters such as softening point, melt viscosity, optical structure, composition revealed by solvent fractionation, etc., and various spinning pitches different in properties can be used for spinning. Fundamentally, however, it is important that the spinning pitch contains no solid nor gas under the conditions of spinning and has a uniform flow property.

In the next stage, the resulting spinning pitch is formed into fiber to obtain a pitch fiber. Usually, melt spinning is suitable for producing a continuous long fiber, and centrifugal spinning is suitable for producing cotton-like short fiber or producing a drawn and arranged assembly of medium fiber having a medium length, i.e. sliver or two. The spinning temperature, hall number, drawing rate, stretch ratio, etc. may be selected appropriately so as to meet with the desired purpose. The spun pitch fiber usually has a fiber diameter of about 5 to 30$\mu$ (microns). If the fiber diameter is too great, the fiber properties are apt to deteriorate. If the fiber diameter is too small, an economical spinning process is difficult to secure.

In converting the pitch fiber into a carbon fiber, the thermoplastic pitch fiber must be subjected to an oxidative treatment prior to the carbonization with heat, by which the pitch fiber is converted to an infusible fiber or a fiber which does not fuse even if heated (the so-called infusibilizing treatment). Usually, the infusibilization is achieved by subjecting a pitch fiber to an addition reaction of oxygen or an oxidizing substance and thereby crosslinking the pitch molecules. For this purpose, various oxidizing gases and liquid or solution-formed oxidants have hitherto been proposed. Since this type of reactions progress from the surface of fiber, a pitch fiber of smaller diameter is expected to be infusibilized more rapidly. In the infusibilizing process, the pitch fiber is handled either in the form of being rolled and packaged, or in the form of being stretched continuously, or in the form of being accumulated on conveyer or in basket. An appropriate form may be selected depending on the intended final form of the fiber.

Next, the infusibilized fiber is heated in an inert gas at a temperature of about 600° to 3,000° C. to convert it to a carbon fiber (carbonization; when the temperature of this treatment is higher than 2,000° C., it is sometimes called "graphitization"). By this treatment, the volatile components present in the infusibilized fiber and the part having a thermally instable structure in the pitch molecule are decomposed and vaporized off, and the aromatic ring structure in the molecule is grown. Thus, the fiber becomes rich in carbon content and sometimes becomes close to graphite crystal, and there is obtained a carbon fiber having high strength and elastic modulus.

For practising the heating, hot air oven, electric furnaces using various heating elements, plasma furnace and the like can be used. Since a large quantity of energy is consumed in any of these cases because of the high temperature, it is necessary to carry out the carbonization with a high efficiency. If desired, the carbonization may be carried out in two stages (low and high temperatures) or in more stages.

If desired, the carbon fiber thus obtained is further subjected to surface treatment, oiling, unwinding, and sometimes cutting, fibrillation, etc. However, these treatments will not be mentioned herein because of their generality.

All the above-mentioned processes are important for producing a carbon fiber. Among them, the infusibilizing step usually takes a long period of time and various troubles deteriorating the performances of carbon fiber often occur in this step. Accordingly, effective practice of this process is quite important to an economical production of carbon fiber.

The infusibilization is carried out for the purpose of oxidizing the thermoplastic pitch fiber to convert it into an infusible fiber having no thermoplasticity and thereby preventing the softening and deformation of the fiber in the subsequent carbonizing step. For achieving this purpose, a pitch fiber is usually heat-treated and oxidized while slowly elevating its temperature in an oxidizing gas. If control of this reaction is unsatisfactory, an uncontrollable reaction takes place to incur melting, inflammation, etc. Even if such uncontrollable reactions do not take place, a phenomenon called "sticking" often takes place to make the practice of this process difficult. As used herein, the term "sticking" means such a phenomenon that, in the infusibilizing process, adjacent pitch fibers are softened and deformed or sometimes a third material adheres to the contact area of the plural pitch fibers and, as its result, the pitch fibers are fixed together.

In a sticked pitch fiber, the fibers keep fixed after the subsequent carbonization, so that it lacks flexibility and its commercial value is damaged greatly. Sometimes, such a fiber has no commercial value at all.

The sticking phenomenon is apt to occur when pitch fiber is handled in the form of a tow or a strand. The handling of pitch fiber in the form of tow or strand is most suitable for the production of continuous filament, and it is quite difficult industrially to obtain a continuous carbon fiber of high quality by other methods such as drawing and arranging cotton-like or wool-like pitch fiber after infusibilization or after carbonization. Viewed from another angle, however, the infusibilization of pitch fiber in the form of tow or strand is not advantageous in the point of prevention of sticking. For, in the form of tow or strand, pitch fibers are bundled at a high density and have many contact points successively in the longitudinal direction. If a pitch fiber is heated in such a state for the purpose of infusibilization, the softened pitch fiber is readily stuck together at every contact point. In addition, the heat generated by the oxidation of pitch is accumulated in the tow or strand, which locally elevates the temperature of tow or strand and induces melting and sticking of mutually contacted pitch fibers. Further, the volatile substances evaporated from pitch fiber or the substances exuding out of pitch fiber cannot be rejected outside the fiber bundle but they are accumulated at the contact points, which acts as a sort of binder to cause the sticking.

Regarding the infusibilization of pitch fiber, a variety of techniques have hitherto been proposed. They include the method using a solution of oxidant (for example, Japanese Patent Publication No. 21,904/72, Japanese Patent Publication No. 21,905/72, etc.), the method using an oxidative gas (for example, Japanese Patent Publication No. 42,696/73, Japanese Patent Kokai (Laid-Open) No. 75,828/74, etc.), the combined use of the above-mentioned two agents (for example, Japanese Patent Kokai (Laid-Open) No. 88,729/76, Japanese Patent Kokai (Laid-Open) No. 30,915/84, etc.), and the like. However, the effect which these techniques exhibit is predominantly a shortening of the period of time required for infusibilization, and none of these methods is satisfactory from the viewpoint of preventing the sticking of pitch fibers. Further, the use of an oxidant such as hydrogen peroxide, chromic acid and the like is undesirable from the viewpoint of the safety of the process.

As a method for preventing the sticking of pitch fiber strands, combined use of a water-soluble oxidant, a water-soluble surfactant and finely powdered graphite has also been proposed (Japanese Patent Kokai (Laid-Open) No. 128,020/80). However, this technique also uses an oxidant, and therefore it is not desirable from the viewpoint of safety, as has been mentioned above.

Accordingly, an object of the present invention consists in providing a process for the infusibilization of pitch fibers having an effect of preventing the sticking of tow-formed or strand-formed pitch fibers at the time of infusibilizing treatment. Another object of the invention consists in providing a process for the infusibilization of pitch fibers exhibiting the above-mentioned effect without using those oxidants which are dangerous from the viewpoint of safety.

The process of the invention having the above-mentioned effect is surprisingly simple. Thus, the objects of the invention can be achieved by treating a pitch fiber with a dispersion of a finely powdered solid lubricant in water or a solvent prior to the infusibilizing treatment (at an appropriate time selected out of the period from the prevention of melting to the infusibilization) and heat-treating the pitch fiber to which the finely powder of solid lubricant adheres in an oxidative gas to perform the infusibilization.

DETAILED DESCRIPTION OF THE INVENTION

As used herein, the term "solid lubricant" means a solid material which is used in the form of a thin film or a powder for the purpose of protecting the surface of relatively moving bodies against the injury caused by the motion and decreasing the friction and abrasion, and its known typical examples include the powders of graphite, molybdenum disulfide, tungsten disulfide, boron nitride, fluorinated graphite, talc and the like.

Among the materials, the powders of molybdenum disulfide and tungsten disulfide have an effect of preventing the sticking of pitch fiber, as mentioned in the preceding patent of the present inventors (Japanese Patent Application No. 281,318/84). Further, the sticking preventive effect of talc is also mentioned in the preceding patent of the present inventors (Japanese Patent Application No. 195,400/85).

Subsequently to the above-mentioned inventions, the inventors determined that materials capable of exhibiting such an effect are not limited to molybdenum disulfide, tungsten disulfide and talc but the particles of substances called "solid lubricant" are generally suitable for use in the prevention of pitch fibers from the sticking.

Thus, there was obtained a conclusion that applying a specified solid powder to pitch fiber followed by its infusibilization is necessary for preventing the sticking occurring in the process of infusibilization, that said solid must have a softness enough to protect the pitch fiber against injury and at the same time a lubricant performance enough to prevent the abrasion between pitch fibers, and that the materials called solid lubricant above are most suitable for satisfying the above-mentioned conditions. Based on this finding, the present invention was accomplished.

The particle diameter of the solid lubricant suitable for use in the invention is as follows. Thus, since the mechanism of the prevention of sticking according to the invention consists in forming interstices between pitch fibers, particles of which diameter is smaller than a critical value (for example, $0.5\mu$) are inferior in the sticking preventive effect. Further, the use of unnecessarily fine particles is disadvantageous from the economical point of view. On the other hand, since pitch fibers usually have a fiber diameter ranging from about $5\mu$ to $30\mu$, too coarse particles having a diameter exceeding about $5\mu$, for example, are difficult to make uniformly permeate between fibers. Further, if the particle is coarse, its dispersion cannot keep a sufficient stability. From the viewpoint mentioned above, the preferable range of particle diameter is about $0.5\mu$ to about $5\mu$.

As used herein, the term "dispersion" means a material prepared by dispersing a powder of solid lubricant into an appropriate dispersion medium. It includes those of which dispersion stability is enhanced by a combination of physical means. As the solvent, a variety of solvents such as hexane, heptane, methanol, ethanol and the like can be used, among which methanol and ethanol are preferred. Water is also usable as said solvent. Strong solvents for pitch such as quinoline, chloroform and the like are undesirable, because they can injure the pitch fiber. The use of benzene is also restricted for the same reason as above. Solvents of which the boiling point or boiling point range is higher than 200° C. are undesirable, because they obstruct the flow of oxidative gas. In the invention, the solid lubricant is used in the form of a dispersion because it facilitates a uniform treatment and it readily permeates into the spaces between fibers.

In carrying out the treatment, the dispersion is used either as it is or after adjusting its concentration to an appropriate value. The concentration of solid lubricant powder used for the treatment is preferably in the range of 5 to 50%. Although solvent systems require no particular assistant at the time of treatment, aqueous systems require use of a surfactant for the purpose of improving the wettability of pitch fiber. As said surfactant, any of the cationic, anionic and nonionic surfactants can be used. Among them, the nonionic surfactant is preferred because it is not affected by the ions of other components present in the dispersion. Examples of said nonionic surfactant include polyoxyethylene alkylphenol ether, polyoxyethylene alkyl ether and ester, ethylene oxide-propylene oxide block copolymer, and the like. The use of the surfactant in too large an amount is undesirable because it obstructs the flow of oxidative gas. On the other hand, if its amount is too small, the effect of wetting and dispersing is insufficient. Usually, the surfactant is preferably used in an amount of about 0.5 to 1.0%.

The treatment of pitch fiber with the dispersion may be carried out at any appropriate time selected out of the range from the time just after the fiber formation of pitch fiber to the time just before the infusibilization. As the method of the treatment, various methods such as spray coating, roller coating, dipping and the like can be used. At any rate, the powder of solid lubricant must be applied to the pitch fiber as uniformly as possible.

As has been mentioned above, general solid lubricants can be used for preventing sticking occurring in the process of infusibilization. More preferably, however, a substance exhibiting an excellent property not only in the infusibilization process but also in the subsequent carbonization process should be selected.

This is for the following reason. Thus, because the infusibilized fiber (the fiber after the infusibilization) is still fragile, the solid lubricant powder applied to pitch fiber prior to the infusibilization treatment is usually not removed from the infusibilized fiber, but the infusibilized fiber having the solid lubricant powder adhering to its surface is directly introduced into the carbonization process.

Accordingly, it is preferable that the solid lubricant used in the invention remains stable during the heat-treatment in the infusibilization process which is carried out in an oxidative atmosphere at a maximum temperature of 250° C. to 400° C. and, at the same time, it remains stable also during the heat-treatment in the carbonization process which is carried out in an inert atmosphere at a maximum temperature of 600° C. to 3,000° C. It is particularly desirable that the solid lubricant remain stable under the condition of heat-treatment at 1,000° C. or above which is a necessary condition of carbonization for manifesting sufficient strength of carbon fiber.

The inventors have repeatedly studied the above-mentioned points to find that, among the known solid lubricants, graphite, boron nitride and fluorinated graphite fulfill the above-mentioned condition.

Graphite is stable up to a temperature somewhat higher than 450° C. in an atmosphere of air and up to a temperature somewhat higher than 2,500° C. in an inert atmosphere. Boron nitride is stable up to a temperature somewhat higher than 500° C. in an atmosphere of air and up to a temperature somewhat higher than 2,000° C. in an inert atmosphere. Fluorinated graphite is stable up to 400° C. in the atmosphere of air. Although it decomposes at a temperature higher than 400° C., the product of the decomposition is graphite. This means that fluorinated graphite shows a stability equal to that of graphite at a temperature higher than 400° C.

Based on these facts, it will be understandable that applying the powder of graphite, boron nitride or fluorinated graphite to pitch fiber is effective for preventing the sticking of pitch fiber in the infusibilization process and, in addition, it exercises no influence upon the carbon fiber in the process of carbonization practised at a temperature higher than 1,000° C., so that it is a method suitable for the production of carbon fiber of high performances.

Whether the spinning pitch used as the starting material of pitch fiber to which the present invention is applied is an optically isotropic pitch or an optically anisotropic pitch, the effect of the invention can be exhibited.

As the state of pitch fiber, a loosely drawn and arranged state (the so-called tow state) or the tightly drawn and arranged state (the so-called strand state) is preferred. The state of cotton where short fibers are entangled at random and the state of wool (silver) where long fibers separated from one another are accumulated are also employable. Since the latter two states originally have only a small number of contact points, the effect of the invention is not great there.

After applying the solid lubricant powder, the fiber is heat-treated in an oxidizing atmosphere while elevating the temperature, to practise the infusibilization. As the oxidizing gas for the infusibilization, air, oxygen, ozone, nitrogen dioxide, sulfur dioxide, halogen and the like can be used, among which air and oxygen are preferable from the viewpoint of economy. The rate of the elevation of temperature is preferably about 2° C. to 10° C./minute, and the maximum temperature of the treatment is 250° C. to 400° C.

When the invention is applied, the use of those oxidants which have been used in the prior processes can be excluded, which makes the procedure quite safe. Further, by applying the above-mentioned speed of temperature elevation, the period of time required for infusibilization can be varied at will. For example, the period of time required for infusibilization can be made as short as 30 to 120 minutes. It should be noted here that, according to the prior processes using an oxidant only, the sticking could not be prevented even if consuming a period longer than 120 minutes and a carbon fiber of high quality could be obtained only by consuming a yet longer period of time for the infusibilization.

The infusibilization system of the invention can directly be introduced into the carbonization process, without carrying out washing or the like particularly.

If a tow or a strand, i.e. an assembled bundle of fibers, is wet with water, the fibers adhere to one another and, as the result, the shape of the tow or strand becomes more slender than before the wetting, generally speaking, and this slender shape is maintained as it is throughout the infusibilization process and the carbonization process, roughly saying. Such a mutual adhesion of filaments usually promotes the sticking of the filaments in the infusibilization process. According to the present invention, nonetheless, the pitch fiber treated with a dispersion of solid lubricant powder can easily be separated into individual filaments by mildly stroking it after the infusibilization and carbonization processes, and there is obtained a carbon fiber free from sticking.

Such an excellent effect is attributable to that the solid lubricant powder uniformly applied to pitch fiber enters the interstices between pitch fibers to produce fine gaps there, owing to which the contact points between pitch fibers causing the stocking are eliminated and the oxidizing gas becomes flowing between the fibers. Thus, the oxidation reaction can progress uniformly, and the volatile substance generated from pitch fiber at the time of infusibilization can be removed rapidly.

Next, examples of the invention will be mentioned. The examples mentioned herein are only for facilitating the understanding of the process of the invention and its effect and by no means for limiting the scope of the invention.

EXAMPLE 1

An optically anisotropic pitch containing 40% of quinoline-insoluble component, prepared from coal tar, was subjected to melt spinning process to obtain a pitch fiber strand having a fiber diameter of 13μ and a filament number of 2,000. On the other hand, a natural flaky graphite powder having a mean particle diameter of 0.6μ was dispersed into ethanol to prepare three ethanolic dispersions having concentrations of (a) 5% by weight, (b) 10% by weight and (c) 20% by weight. Then, the strand obtained above was dipped into each of these dispersions to obtain three kinds of graphite powder-attached pitch fiber strands. Each of the treated strands was heat-treated in an atmosphere of oxygen at a temperature elevation rate of 5° C./minute and infusibilized over a period of one hour. The infusibilized fiber was then carbonized by heat-treating it in an atmosphere of argon up to a temperature of 1,100° C. to obtain a carbon fiber. The carbon fiber thus obtained could easily be split into individual filaments, and no sticking was noticeable in any of (a), (b) and (c).

In a sedimentation test of the above-mentioned three graphite dispersions, all the dispersions remained stable for a period of 60 minutes or more without showing any sedimentation of graphite powder.

EXAMPLE 2

Three kinds of carbon fibers were prepared by repeating the procedure of Example 1, except that the natural flaky graphite having a mean diameter of 0.6μ was replaced with a boron nitride powder having a mean particle diameter of 0.5μ. The three carbon fibers thus obtained could easily be split into individual filaments without noticeable sticking.

In the sedimentation test of the three kinds of dispersions, all the dispersions kept stable for 60 minutes or more.

EXAMPLE 3

A pitch fiber strand obtained by the same procedure as in Example 1 was dipped in a 10% (by weight) methanolic dispersion of fluorinated graphite powder having a mean particle diameter of 1.2μ to obtain a treated strand. It was heat-treated in an atmosphere of air at a temperature elevation rate of 2° C./minute and infusibilized over a period of 2 hours. The infusibilized fiber thus obtained could easily be split into individual filaments without noticeable sticking.

In the same sedimentation test as above, the dispersion remained stable for 60 minutes.

EXAMPLE 4

An optically anisotropic pitch containing 40% of quinoline-insoluble component, prepared from coal tar, was subjected to a melt spinning process. While carrying out the spinning, the spun fiber was coated just underneath the spinning furnace with a dispersion containing 15% by weight of natural flaky graphite particle having a mean particle diameter of 3μ and 0.5% of polyoxyethylene nonylphenol ether as a surfactant by means of revolving rolls to obtain a treated pitch fiber strand having a fiber diameter of 14μ and a filament number of 400. The pitch fiber strand was infusibilized in an atmosphere of oxygen over a period of 2 hours at an temperature elevation rate of 2° C./minute, and subsequently it was heat-treated in an atmosphere of argon up to a temperature of 1,500° C. for the sake of carbonization to obtain a carbon fiber. The carbon fiber thus obtained could easily be split into individual filaments without noticeable sticking.

In the same sedimentation test as above, the dispersion remained stable for 30 minutes.

EXAMPLE 5

A carbon fiber was produced by repeating the procedure of Example 4, except that the natural flaky graphite particles used in Example 4 was replaced with a boron nitride powder having a mean particle diameter of 0.5μ. The carbon fiber thus obtained could easily be split into individual filaments without noticeable sticking.

In the same sedimentation test as above, the dispersion remained stable for 60 minutes or more.

EXAMPLE 6

An optically isotropic pitch containing 60% of benzene-insoluble component and having a softening point of 230° C., prepared from coal tar, was subjected to a melt spinning process to obtain a pitch fiber strand having a fiber diameter of 13μ and a filament number of 2,000. Then, the strand was dipped in a 10% (by weight) dispersion of natural flaky graphite powder having a mean particle diameter of 0.6μ in acetone to obtain a graphite powder-attached pitch fiber strand. The strand was infusibilized by heat-treating it over a period of 2 hours in an atmosphere of oxygen at a temperature elevation rate os 2° C./minute. Then, the infusibilized fiber was heat-treated in an atmosphere of nitrogen up to a temperature of 1,000° C. for the sake of carbonization to obtain a carbon fiber. The carbon fiber thus obtained could easily be split into individual filaments without sticking.

In the same sedimentation test as above, the dispersion remained stable for 60 minutes or more.

COMPARATIVE EXAMPLE 1

A pitch fiber strand obtained by the same procedure as in Example 1 was dipped in each of the following three liquids: (a) water, (b) ethanol, (c) 20% aqueous solution of hydrogen peroxide. The three kinds of treated strands thus obtained were insolubilized and carbonized by the same procedure as in Example 1. As the result, a sticking took place to give only a rod-like carbon fiber bundle in all of the cases (a), (b) and (c).

COMPARATIVE EXAMPLE 2

A pitch fiber strand obtained by the same procedure as in Example 1 was dipped in each of the dispersion prepared by dispersing a boron nitride powder having a mean particle diameter of 0.5μ into (a) quinoline, (b) chloroform and (c) benzene. The three kinds of treated strands thus obtained were infusibilized and carbonized by the same procedures as in Example 1. As the result, the strand (a) melted in the course of infusibilization. Although the strands of (b) and (c) could be infusibilized and carbonized, the carbon fibers thus obtained were sticked together and were difficult to split into individual filaments.

What is claimed is:

1. A process for the infusibilizing treatment of pitch fiber which comprises, in the production of pitch type carbon fiber, applying a dispersion consisting essentially of a powder of solid lubricant dispersed in organic solvent or aqueous nonionic surfactant-containing solution to a pitch fiber and then subjecting the fiber to an infusibilizing treatment by heating the fiber in an oxidative gas, wherein the organic solvent is hexane, heptane, methanol, acetone or ethanol.

2. A process for the infusibilizing treatment of pitch fiber which comprises, in the production of pitch type carbon fiber, applying a dispersion consisting essentially of a powder of solid lubricant dispersed in organic solvent or aqueous nonionic surfactant-containing solution to a pitch fiber and then subjecting the fiber to an infusibilizing treatment by heating the fiber in an oxidative gas, wherein the organic solvent has a maximum boiling point of 200° C.

3. A process according to claim 1, wherein said powder of solid lubricant has a particle diameter of about 0.5 micron to about 5 microns.

4. A process according to claim 1, wherein said solid lubricant is graphite, fluorinated graphite or boron nitride.

5. A process according to claim 3, wherein said solid lubricant is graphite, fluorinated graphite or boron nitride.

6. The process according to claim 2, wherein the organic solvent is hexane, heptane, methanol, acetone or ethanol.

* * * * *